US009188372B2

(12) United States Patent
Thomas et al.

(10) Patent No.: US 9,188,372 B2
(45) Date of Patent: Nov. 17, 2015

(54) AIR CONDITIONER AND HEAT PUMP CONDENSING UNIT CHASSIS WITH ENHANCED SERVICEABILITY ACCESS

(71) Applicant: Rheem Manufacturing Company, Atlanta, GA (US)

(72) Inventors: Gregory Michael Thomas, Alma, AR (US); Timothy J. Shellenberger, Tyrone, GA (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 391 days.

(21) Appl. No.: 13/717,765

(22) Filed: Dec. 18, 2012

(65) Prior Publication Data

US 2013/0219942 A1 Aug. 29, 2013

Related U.S. Application Data

(60) Provisional application No. 61/602,334, filed on Feb. 23, 2012.

(51) Int. Cl.

| | |
|---|---|
| ***F25B 30/00*** | (2006.01) |
| ***F25B 39/04*** | (2006.01) |
| ***F24F 1/56*** | (2011.01) |

(52) U.S. Cl.
CPC . *F25B 30/00* (2013.01); *F24F 1/56* (2013.01); *F25B 39/04* (2013.01)

(58) Field of Classification Search
CPC ..... F24F 1/56; F24F 1/58; F24F 13/20; F24F 1/46; F25B 39/04
USPC ..... D23/333, 354
See application file for complete search history.

(56) References Cited

U.S. PATENT DOCUMENTS

| | | | |
|---|---|---|---|
| 5,444,990 | A | 8/1995 | McGill, III et al. |
| 7,263,852 | B2 | 9/2007 | Bacchus |
| 2005/0204767 | A1 | 9/2005 | Norrell et al. |
| 2007/0163295 | A1 | 7/2007 | Martin, Sr. et al. |
| 2011/0176257 | A1 | 7/2011 | Uselton et al. |

*Primary Examiner* — Cassey D Bauer
(74) *Attorney, Agent, or Firm* — Haynes and Boone, LLP

(57) ABSTRACT

An air conditioning system condensing unit has a specially designed chassis providing enhanced serviceability access to various air conditioning components operatively disposed therein. A removable vertical peripheral outer side wall section of the chassis underlies a removable peripheral top side wall section thereof. Removal of these two side wall sections creates in the chassis an opening conveniently providing both horizontal and vertical service access to the air conditioning components within the interior of the chassis.

20 Claims, 3 Drawing Sheets

AIR CONDITIONER AND HEAT PUMP CONDENSING UNIT CHASSIS WITH ENHANCED SERVICEABILITY ACCESS

CROSS-REFERENCE TO RELATED APPLICATION

The present application claims the benefit of the filing date of provisional U.S. patent application No. 61/602,334 filed Feb. 23, 2012. The entire disclosure of such provisional application is hereby incorporated herein by this reference.

BACKGROUND OF THE INVENTION

The present invention generally relates to air conditioner or heat pump condensing units and, in a representatively illustrated embodiment thereof, more particularly relates to a specially designed air conditioner or heat pump condensing unit having a chassis with enhanced serviceability access to its internal equipment such as a compressor, condenser coil, expansion vale and reversing valve.

Typical air conditioner or heat pump outdoor units (usually referred to as "condensers" or "condensing units") are normally designed with a configuration resembling a "cube" shape. These outdoor units, although usually cost effective, typically do not offer particularly easy access to air conditioning system components within their outer chassis such as compressor, condenser coil, expansion valve and reversing valve components within the condensing unit chassis. Quite often the only access path to the interior of the condensing unit, to repair and/or remove mechanical components within the condensing unit chassis, is from the top side of the unit through a central fan discharge opening from which a wire fan guard has been removed. This is often quite difficult, and is especially so if the condensing unit is very tall.

Because of this, contractors who install and service condensing units often complain about the difficulty of performing service or replacement of some component parts within a condensing unit. It can easily be imagined how difficult it can be to, for example, use a high temperature torch to unbraze and re-braze the component parts within the condensing unit when access is only provided through the top grill of the unit, or to lift a heavy compressor (that can weigh 50-96 pounds) up and out of the top of the condensing unit through the fan guard opening.

In view of these well known problems, limitations and disadvantages often associated with conventional condensing unit chassis configurations, it would be desirable to provide a condensing unit chassis construction that provides enhanced serviceability access to its interior components. It is to this goal that the present invention is primarily directed.

DETAILED DESCRIPTION

Figure 1:
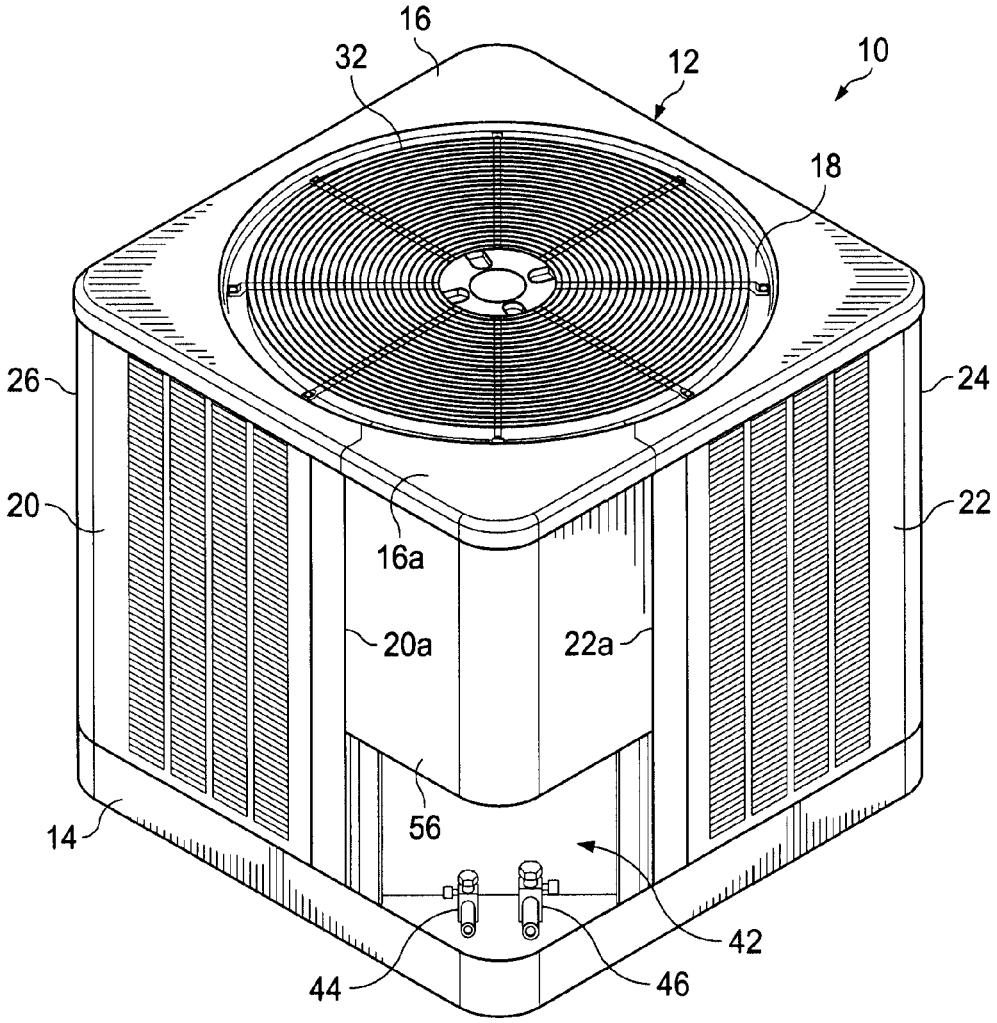
FIG. 1 is a perspective view of the fully assembled condensing unit.
Figure 2:
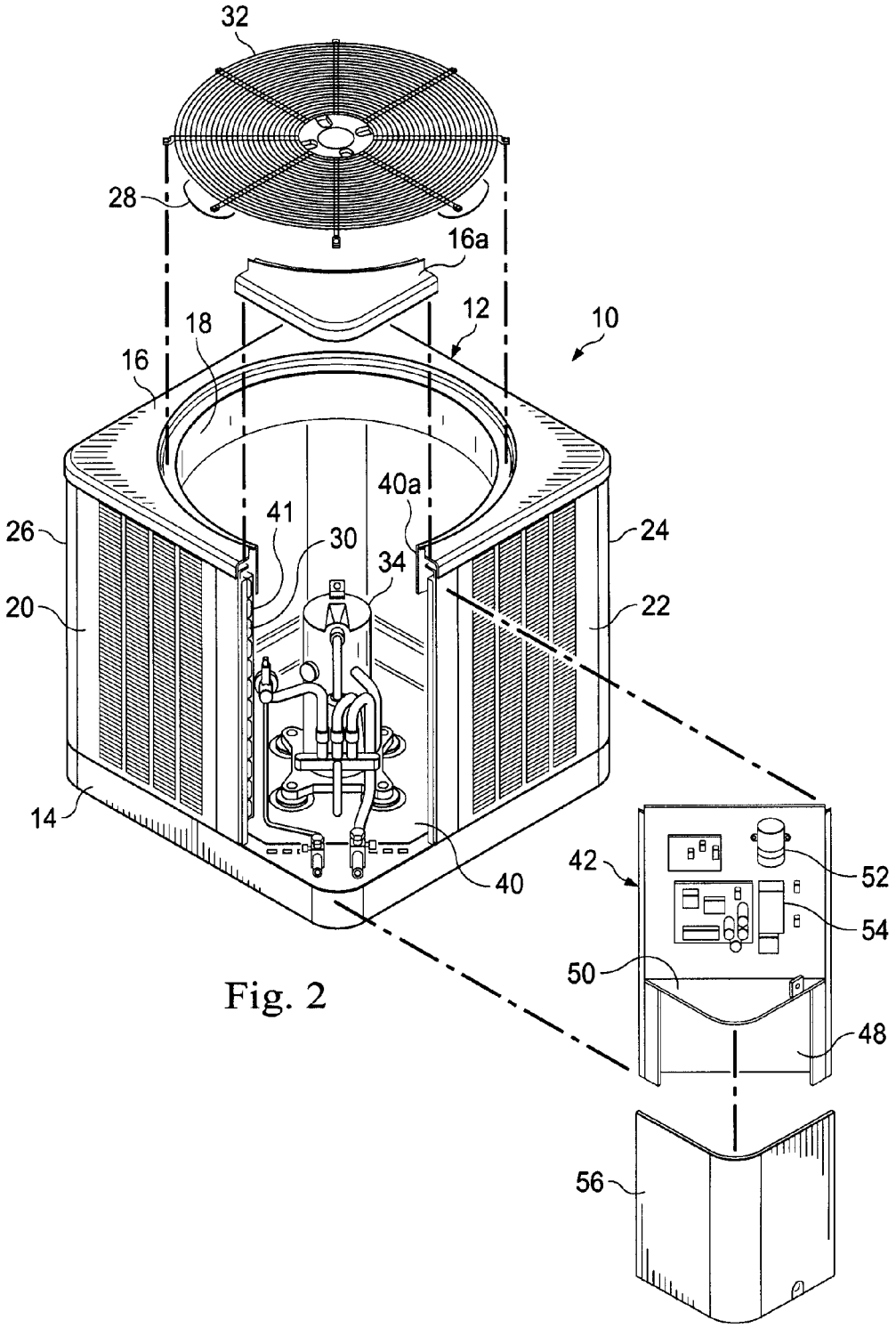
FIG. 2 is a reduced scale, partially exploded perspective view of the condensing unit.
Figure 3:
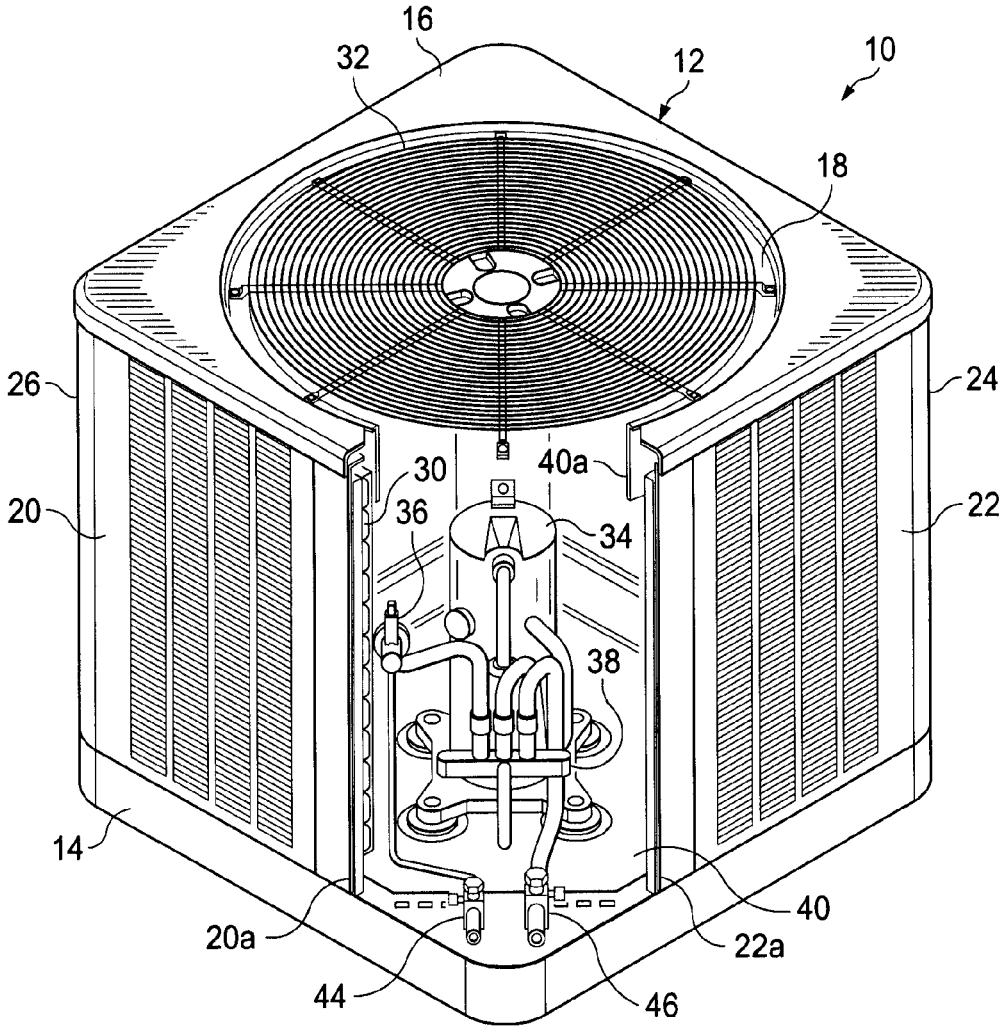
FIG. 3 is a perspective view of the condensing unit similar to that in FIG. 1, but with corner sections of the condensing unit chassis removed to provide enhanced serviceability access to the interior of the chassis for servicing and/or removal of components therein.

Perspectively illustrated in FIGS. 1-3 is an air conditioning system outdoor condensing unit 10 which is representatively a heat pump condensing unit but could alternatively be a dedicated air conditioning-only unit. Condensing unit 10 illustratively has a rectangular shape defined by a generally cubic outer shell of chassis 12 having a rectangular horizontal base 14, a rectangular top side wall 16 with a central circular air discharge opening 18 formed therein, and four louvered vertical side walls 20, 22, 24, and 26 extending between the base 14 and the top side wall 16. While a rectangular shape is preferred for the condensing unit chassis, other chassis shapes could be alternatively employed without departing from principles of the present invention.

During operation of the condensing unit 10, a motor-driven fan 28 (see FIG. 2) rotatably disposed within the top side air discharge opening 18 draws outside air inwardly through the louvered vertical side walls 22,24,26 and 28, across a condenser coil 30 (see FIGS. 2 and 3) disposed within the interior chamber of the chassis 12 and extending around the inner side periphery of the chassis 12, and then discharges the air upwardly through a circular wire fan guard 32 supported within the air discharge opening 18. In addition to the condenser coil 30, various other air conditioning system components are housed within the interior chamber of the chassis 12 and include a compressor 34, an expansion valve 36, and a reversing valve 38 see FIG. 3).

According to a key aspect of the present invention, an opening 40 uniquely providing a combination of both horizontal and vertical access to the interior of the chassis 12 and the components therein is formed through a side wall portion of the chassis 12. Preferably, the access opening 40 is disposed in a vertical corner portion of the chassis 12 between adjacent vertical edges 20*a*,22*a* of the chassis side walls 20,22 which are horizontally foreshortened relative to the other two side walls 24 and 26. Access opening 40, in addition to its vertically extending side portion, has an open top end 40*a* (see FIG. 3) which is normally covered by a removable corner portion 16*a* of the top side wall 16 (see FIGS. 1 and 2). Condenser coil 30 has a horizontal peripheral gap 41 which is aligned with and defines an inward extension of the vertical side portion of the chassis access opening 41.

With the condensing unit 10 in its FIG. 1 fully assembled state, the open top end 40*a* of the access opening or passage 40 is covered by the installed top side wall corner portion 16*a* of the top side wall 16, and the outer side of the opening 40 is covered by a control box bracket structure 42 which is suitably and removably secured to the opposite side wall edges 20 and 22*a* and is positioned horizontally inwardly of liquid and suction valve portions 44,46 of the overall refrigerant circuit. As may be best seen in FIG. 2, the control box bracket structure 42 has a vertical panel portion 48 with a horizontal shelf projecting horizontally outwardly therefrom. Mounted on the outer side of the panel 48, above the shelf 50, are a control box 54 and various electromechanical components collectively designated by the reference numeral 54. A generally L-shaped control box cover 56 is removably secured to the panel 48 over the control box 52 and the electromechanical components 54.

When it is desired to gain service access to the various components within the interior of the chassis 12, such as the compressor 34, expansion valve 36 and reversing valve 38, all that is necessary is to remove the control box cover 56, and then remove the top corner portion 16*a* of the top chassis side wall 16. Once those structures are removed from the condensing unit 10, the control box bracket structure 42, with the control box 52 still attached thereto, can be removed to fully expose the access opening 40 to thereby provide a technician both horizontal access to the components within the chassis 12, through the horizontally facing portion of the opening 40 and the gap 41 in the condenser coil 30, and vertical access to the components within the chassis 12 through the open top end of the opening 40.

The unique provision of the open-topped horizontal access opening 40 formed in the condensing unit chassis 12 provides a variety of advantages over the conventional internal component access path extending only vertically through the chassis via the air discharge opening 18 with the fan guard 32 removed. For example, repair and service of the condensing unit 10 becomes considerably easier without altering the basic "cube" shape of the condensing unit 10. Additionally, the difficulty of replacing the components within the chassis is considerably reduced, and diagnosing the internal component parts of the condensing unit is made significantly easier. Further, because of the presence of the access opening 40, it becomes easier and quicker to clean the condenser coil 30.

It should be noted that the removable structure 42 illustratively positioned on a corner portion of the condensing unit chassis 12 uniquely provides two functions—(1) it houses some of the control components such as the illustrated electromechanical components 54, and (2) it defines a removable cover structure for the opening 40 to block it when it is not needed.

The open-topped horizontal component access opening 40 formed in the condensing unit chassis 12 is preferably formed, as illustrated, on a corner portion of the chassis 12 and extends upwardly from the base 14 to the chassis top side wall 16. As can be seen, the positioning of the access opening 40 in such corner portion maximizes the area of the open top end of the opening 40 compared to forming the opening 40 between opposing corner portions of the chassis 12. However, it will be readily appreciated by those of skill in this particular art that, if desired, the side access opening 40 could alternatively be formed between such corner portions without departing from principles of the present invention—particularly in instances wherein the side walls of the chassis 12 were horizontally outwardly spaced further apart from the air discharge opening 16.

The foregoing detailed description is to be clearly understood as being given by way of illustration and example only, the spirit and scope of the present invention being limited solely by the appended claims.

What is claimed is:

1. An air conditioning system condensing unit comprising:
a plurality of air conditioning components; and
a chassis having a top side wall with a removable top peripheral section positioned at a single corner of said side wall, a bottom side portion, and a vertical outer side wall structure extending between said top side wall and said bottom side portion, the chassis defining an interior chamber within which said plurality of air conditioning components are operatively disposed,
said outer side wall structure having a removable side peripheral section that is in underlying alignment with said removable top peripheral section of said top side wall and extends from said top side wall to adjacent said bottom side portion, wherein said removable top peripheral section and said removable side peripheral section are removable to create in said chassis an opening providing both horizontal and vertical service access to said plurality of air conditioning components.

2. The condensing unit of claim 1 wherein:
said condensing unit is a heat pump condensing unit.

3. The condensing unit of claim 1 wherein:
said condensing unit is a dedicated air conditioning-only condensing unit.

4. The condensing unit of claim 1 wherein:
said condensing unit further comprises at least one air conditioning component carried by said removable side peripheral section of said outer side wall structure for removal therewith from said condensing unit.

5. The condensing unit of claim 4 wherein:
said at least one air conditioning component carried by said removable side peripheral section of said outer side wall structure includes a control box.

6. The condensing unit of claim 4 wherein said removable side peripheral section of said outer side wall section comprises:
a vertical wall panel removably secured to the balance of said outer side wall structure over a horizontally facing portion of said opening,
a transverse, outwardly extending bracket secured to a vertically intermediate portion of said vertical wall panel below said at least one component carried by said removable side peripheral section of said outer side wall structure, and
a cover member removably secured to said vertical wall panel over said at least one air conditioning component carried by said removable side peripheral section of said outer side wall structure.

7. The condensing unit of claim 1 wherein:
said top side wall has a generally rectangular shaper.

8. The condensing unit of claim 7 wherein:
said top side wall has a central air discharge opening extending therethrough and having a periphery, and
said removable top peripheral section of said top side wall extends outwardly from said periphery of said central air discharge opening.

9. An air conditioning system condensing unit comprising:
a plurality of air conditioning components; and
a chassis within which said plurality of air conditioning components are operatively disposed,
said chassis having a generally rectangular configuration and including a vertically extending side corner portion and at side with a removable top corner portion positioned at a single corner of said top side, the vertically extending side corner portion and the top corner portion being removable to expose an opening providing both horizontal and vertical service access to said plurality of air conditioning components within said chassis.

10. The condensing unit of claim 9 wherein:
said side corner portion of said chassis and said opening vertically extend along substantially the entire height of said chassis.

11. The condensing unit of claim 9 wherein:
said condensing unit is a heat pump condensing unit.

12. The condensing unit of claim 9 wherein:
said condensing unit is a dedicated air conditioning-only condensing unit.

13. The condensing unit of claim 9 further comprising:
at least one additional air conditioning component carried by said side corner portion for removal therewith from the balance of said chassis.

14. The condensing unit of claim 13 wherein:
said at least one additional air conditioning component includes a control box.

15. The condensing unit of claim 9 wherein:
said top side comprises a central air discharge opening extending therethrough and having a periphery, and
said side corner portion extending outwardly from said periphery.

16. The condensing unit of claim 15 wherein:

said side corner portion includes a vertically elongated chassis wall panel structure removable from the balance of said chassis to expose a horizontally facing side portion of said opening.

17. The condensing unit of claim 16 wherein:

said top corner portion of said top side is removable from said chassis separately from said vertically elongated chassis wall panel structure.

18. An air conditioning system condensing unit comprising:

a plurality of air conditioning components; and a chassis substantially encompassing the plurality of air conditioning components, the chassis comprising:

a bottom side portion;

a top side portion having a top access opening between two perpendicular edges of the top side portion, the top access opening providing vertical access to the plurality of air conditioning components;

a vertical outer side wall structure extending between the bottom side portion and the top side portion, the vertical outer side wall structure comprising a side access opening between two perpendicular vertical sidewalls of the vertical outer side wall structure, the side access opening aligned with the top access opening, the side access opening providing horizontal access to the plurality of air conditioning components;

a top removable portion adapted to fit within and cover the top access opening; and a side removable portion adapted to fit within and cover the side access opening.

19. The condensing unit of claim 18, wherein the side removable portion comprises a control box.

20. The condensing unit of claim 19, further comprising, an L-shaped control box cover adapted to cover the control box.

* * * * *